United States Patent [19]

Delago

[11] 4,448,396

[45] May 15, 1984

[54] HEAVE MOTION COMPENSATION APPARATUS

[75] Inventor: Pierre C. Delago, Afton, Minn.

[73] Assignee: American Hoist & Derrick Company, St. Paul, Minn.

[21] Appl. No.: 352,082

[22] Filed: Feb. 25, 1982

[51] Int. Cl.[3] ..... B66D 1/48

[52] U.S. Cl. ..... 254/340; 254/361; 254/900; 414/138

[58] Field of Search ..... 254/900, 268, 270, 273, 254/275, 340, 361, 274; 414/138, 139

[56] References Cited

U.S. PATENT DOCUMENTS

| | | | |
|---|---|---|---|
| Re. 27,261 | 12/1971 | Bromell et al. | 114/5 |
| 3,512,657 | 5/1970 | Chambers . | |
| 3,530,669 | 9/1970 | Bromell et al. | 60/52 |
| 3,591,022 | 7/1971 | Polyakov . | |
| 3,624,783 | 11/1971 | Chang | 254/900 X |
| 3,648,858 | 3/1972 | Barron et al. . | |
| 3,662,991 | 5/1972 | Lakiza et al. . | |
| 3,675,900 | 7/1972 | Barron et al. . | |
| 3,753,552 | 8/1973 | Barron . | |
| 3,794,187 | 2/1974 | Begault . | |
| 3,804,268 | 4/1974 | Barron et al. . | |
| 4,003,472 | 1/1977 | Reynolds et al. . | |
| 4,021,019 | 5/1977 | Sanders . | |
| 4,025,055 | 5/1977 | Strolenberg . | |
| 4,118,012 | 10/1978 | Kerr et al. . | |
| 4,126,298 | 11/1978 | Lub . | |
| 4,132,387 | 1/1979 | Somerville et al. . | |
| 4,136,391 | 1/1979 | Eterno et al. | 364/478 |
| 4,147,330 | 4/1979 | Eik . | |
| 4,166,545 | 9/1979 | Martinussen et al. | 414/139 |
| 4,174,188 | 11/1979 | Brun | 414/139 |
| 4,179,233 | 12/1979 | Bromell | 414/139 |
| 4,180,362 | 12/1979 | Stair | 414/139 |
| 4,215,851 | 8/1980 | Holmen | 254/277 |
| 4,324,385 | 4/1982 | Cojean et al. | 254/900 X |
| 4,349,179 | 9/1982 | Barber | 254/900 X |

OTHER PUBLICATIONS

Load Transfer at Sea by W. R. McGill, pp. 35, 36, 38 and 41 of Technology of the Marine Environment for Engineering/Operating Men, Automatic Drilling Machines, Inc., "Heave Compensator Positive Control System," dated Sep. 1, 1976.

Cargo Handling Unit for Safe Offloading of Supply Vessels of Ateliers et Chantiers de Bretagne-ACB of Prairie-Au-Duc Sedame Hook Block Heave Compensator Brochure.

*Primary Examiner*—John M. Jillions

*Attorney, Agent, or Firm*—Kinney & Lange

[57] ABSTRACT

A heave motion compensation appartus is used to move a load from a supply ship in heavy seas to a platform on an oil rig. A main load line extending down from a point of a crane boom mounted on the oil rig is driven by a pair of hydraulic main hoist drum motors. One of the motors is a variable displacement swash-plate type motor. The motors are driven through a hydrostatic transmission by a pair of variable displacement hydraulic pumps. A signal line running over the boom point is attached to the supply vessel and maintained taut. Sensor and control means reading movement of the signal line with respect to the first platform is used to control the displacement of one of the main hoist pumps to cause an outer end of the main hoist line to move up and down with the supply vessel. The other pump is controlled to raise and lower the outer end of the main load line. The main load line is attached to the load. A signal is generated by the sensor and control means to indicate upward movement of the outer end of the main load line, and this signal is used to generate a signal representative of the rate of change of the speed of the outer load line and the load attached thereto. On demand by the operator, the control means determines when the supply vessel is moving up with respect to the oil rig and the rate of change of velocity is zero. The control means then moves the variable displacement main hoist drum motor and the two variable displacement main hoist pumps to maximum displacement to cause the main load line to pick the load from the supply vessel.

15 Claims, 2 Drawing Figures

32
36
14
70
18
22
28
24
16
36
12
70
10
38
72
84
82
86
80
90
88
82
80

32
70
18
36
22
30
14
14
26
16
28
12
24
20
36
62
104
112
44
96
UP
DN
UP
DN
42
102
110
62
100
108
MF
70
46
44
MF
MV
60
40
38
120
72
94
54
86
84
66
58
52
82
COMPUTER
98
PV
64
56
PV
88
PV
50
68
PRIME MOVER
116
57
118
118
GEAR BOX
118
90

HEAVE MOTION COMPENSATION APPARATUS

BACKGROUND OF THE INVENTION

1. Field of the Invention

This invention has relation to cranes designed to pick up and deliver loads to and from a first platform such as an offshore oil rig, and a second platform such as a lighter or supply boat, during a run of heavy seas, for example. The cyclical vertical motion of the second platform with respect to the first, plotted against time closely approximates a sine wave.

2. Description of the Prior Art

In comparatively recent times, such thought has been given to the problem of using a crane mounted to a relatively stable platform for lifting a load from the deck of a supply ship or the like in heavy weather at precisely the right time so as to try to avoid the danger of damage to the load or cargo and/or to the supply ship, to try to minimize the possibility of destructive overloads on the crane and its accutrements mounted on the first platform, and, at the same time, to minimize the necessary weight, strength and power of the crane and the power equipment associated with it and its winches.

It is well known to use a crane mounted on a first platform such as an offshore oil rig and having its boom extending outwardly from the platform to position its boom point in vertical clearing relation to a second platform such as a supply vessel or lighter on which a load to be transferred to the first platform is located. Typically, such structure will have a main hoist drum on which is operably wound or mounted a main load line that extends up the boom and over an appropriate sheave at the boom point, the outer end of the load line carrying a main hook or other device for fastening to the load to be picked off of the second platform. In order to attempt to control the main line hook so that there is little or no relative movement with respect to the second platform, others have used a signal line or messenger line which extends from a signal line drum or winch on the first platform, up the boom, over the boom point, and down into a fastened or fixed relationship with respect to the second platform. Means have been provided for monitoring the difference in motion between the main hoist drum and the signal drum so that the main hoist drum motor can be operated so as to insure that the motion of the main hoist drum is in sympathy with the motion of the signal drum. See U.S. Pat. No. 4,132,387 to Somerville et al, granted in January of 1979, for example.

Other patents which disclose the use of some kind of a signal line held or secured with respect to the deck of a supply boat, and running back over a boom point of a crane boom situated on an offshore platform or the like are:

U.S. PATENTS

U.S. Pat. No. 3,591,022—Polyakov et al—July 6, 1971
U.S. Pat. No. 3,648,858—Barron et al—Mar. 14, 1972
U.S. Pat. No. 3,662,991—Lakiza et al—May 16, 1972
U.S. Pat. No. 3,675,900—Barron et al—July 11, 1972
U.S. Pat. No. 3,753,552—Barron—Aug. 21, 1973
U.S. Pat. No. 3,804,268—Barron et al—Apr. 16, 1974
U.S. Pat. No. 4,025,055—Strolenberg—May 14, 1977
U.S. Pat. No. 4,126,298—Lug—Nov. 21, 1978

U.S. Pat. No. 4,166,545—Martinussen et al—Sept. 4, 1979.

During a search of the prior art, other patents have been located showing structure which relies on a means of sensing the relative vertical positioning of first and second platforms having a cyclical vertical movement with respect to each other. These structures could rely on a signal line, but rely on other means. These U.S. patents are:

U.S. Pat. No. 4,118,012—Kerr et al—Oct. 3, 1978
U.S. Pat. No. 4,179,233—Bromell et al—Dec. 18, 1979
U.S. Pat. No. 4,136,391—Eterno et al—Jan. 23, 1979.

One proposed solution to the problem presented is set out in an article entitled "*Load Transfer at Sea*", which appeared in the February 1978 issue of the magazine "*Ocean, Resources Engineering*". The author of the article is W. I. McGill of Ferranti Offshore Systems Ltd. of Edinburgh, Scotland. Mr. McGill points out the danger of a "snatch lift" which will take place when the load is lifted from a supply boat while the supply boat is on the downward part of its cyclic journey away from the platform level of the offshore oil rig. This kind of lift will result in a very high shock load to the crane.

The McGill article also illustrates how secondary collisions can occur should the lift-off be attempted while the supply vessel is in the trough of its cyclic movement. The author takes the position that the lift-off should occur "at or near the peak of the heave". He states that: "The ideal point of a lift is where the heave of velocity has reduced to the hoist velocity of the crane." The optimum lift point according to this author is so labeled in FIG. 4 of the article. A hand-held signal line is operated by a crewman on the supply ship standing in adjacent relation to the load to be transferred. Sensors monitor the movement of the two platforms with respect to each other, and when called upon by the crane operator, the sensors will, at the chosen time, cause the main hoist to draw in the main line to lift the load at the point illustrated at FIG. 4. The author points out that a main load line speed of 12 feet per second is required for effective operation.

On Dec. 4, 1978, Automatic Drilling Machines, Inc. submitted a proposal entitled "AUTOMATIC DRILLING MACHINES, INC.—HEAVE COMPENSATOR POSITIVE CONTROL SYSTEM" and dated Sept. 1, 1976. The proposal refers to U.S. Pat. No. 3,530,669 granted to Bromell et al on Sept. 29, 1970 and U.S. Pat. No. 27,261 granted to Bromell et al on Dec. 28, 1971. The principle of operation of Automatic Drilling Machine, Inc. system is based upon the utilization of pump-controlled hydraulic power to move one or two large cylinders located between the traveling block and the hook. These cylinders will stroke up and down in response to the heave of the ship.

Similar systems are shown in such U.S. Patents as:

U.S. Pat. No. 3,512,657—Chambers—May 19, 1970
U.S. Pat. No. 3,794,187—Begault—Feb. 26, 1974
U.S. Pat. No. 4,003,472—Reynolds et al—Jan. 18, 1977
U.S. Pat. No. 4,215,851—Holmen—Aug. 5, 1980.

A brochure or brochures entitled "CARGO HANDLING UNIT FOR SAFE OFFLOADING OF SUPPLY VESSELS" of ATELIERS ET CHANTIERS DE BRETAGNE-ACB of Prairie-Au-Duc 44200 Nantes-France, including Disclosures No. 330; No. 330.977; and No. 317 disclose a cargo handling unit which is fitted with a self-tensioning double drum winch which automatically compensates for the movement of a vessel's deck heaving in heavy, fast running seas. Like the Ferranti system in the article entitled "*Load Transfer at Sea*", the ACB cargo handling unit is timed to pick the load "just before the wave peaks". This is done by determining the point where the supply vessel is at the top of a heave and has no vertical movement.

A brochure disclosing the SEDAME HOOK BLOCK HEAVE COMPENSATOR illustrates a two-pulley compensasation system which attempts to take the relative movement of the two platforms into account through pulleys situated between the boom point and the main hook.

During a search made preparatory to preparing the present specification, the following additional U.S. patents were located:

U.S. Pat. No. 4,021,019—Sanders—May 3, 1977
U.S. Pat. No. 4,147,330—Eik—Apr. 3, 1979
U.S. Pat. No. 4,174,188—Brun—Nov. 13, 1979
U.S. Pat. No. 4,180,362—Stair—Dec. 25, 1979.

It is believed that these patents are not as pertinent as some of the prior art cited above.

Neither the inventor nor those in privity with him are aware of any prior art which is closer than that discussed above or of any prior art which anticipates the claims herein.

SUMMARY OF THE INVENTION

A heave motion compensation apparatus is used for transporting a load between two platforms moving vertically with respect to each other with a cyclical motion. For example, an offshore oil rig having a relatively stable first platform with a crane mounted on it is used as a base to receive a payload which is offloaded from a supply vessel or tender providing a second platform and moored under the point of the boom of the crane, but having a cyclical movement up and down due to wave action. This vertical movement of the second platform with respect to the first is a complex one due to the wave action being generated from several directions. However, the operation of the apparatus of the invention can be effectively explained and understood when the cyclical action of the movement of the second platform toward and away from the first as plotted against time is considered as a sine wave.

Moving up and down with the periodicity of a generated sine wave or something close to it, the supply vessel containing the second platform reaches a peak where the upward vertical movement ceases just before the downward motion begins. The platform then begins to accelerate downward and reaches a trough where the downward vertical movement ceases just before the upward motion begins again. The platform then begins an acceleration in the upward direction. When the platform reaches some intermediate vertical position, acceleration in the upward direction ends and deceleration in the upward direction sets in. According to the present invention, this critical point of zero rate of change of vertical upward movement is taken as an ideal point for lift off of the load from the second platform by a load line extending downward from the boom point of the crane mounted on the first platform. At this critical point, the second platform and the load on it have the maximum upward velocity imparted by wave movement.

In the form of the invention as shown, a signal line extends from the first platform up over the crane boom point and down to be fixed to the second platform at a point adjacent to the load to be transported. Means is provided on the first platform to reel in and out on the signal line to keep it taut. Sensor means is provided to monitor the longitudinal movement of the signal line with respect to a point on the first platform to determine the speed of the second platform with respect to the first platform, the direction of vertical movement toward or away from the first platform, and the point at which the rate of change of speed of the second platform with respect to the first is zero.

In the form of the invention as shown, a main hoist winch includes a main hoist drum drivingly connected through appropriate gearing to hydraulic motors. Such a motor can be, for example, a hydraulic variable displacement first main hoist drum motor which is maintained at zero stroke at all times except when hoisting or lowering hook loads. Another can be a hydraulic second main hoist drum motor which can be of the fixed displacement type.

The motors are driven by hydraulic fluid under pressure from two hydraulic variable displacement pumps. A first such pump can be a hydraulic platform locator pump which is controlled by the signal sensor means to cause the pump to deliver a variable flow to the fixed displacement main hoist motor such that the main hoist drum is driven to cause a main load line extending from the main hoist drum up over the boom point and down toward the second platform to follow the motion of the second platform.

A second of such pumps is under the control of the crane operator through a main load line control means to deliver hydraulic fluid to the main hoist drum motors to give a downward or upward component of movement of the outer end of the load line toward or away from the second platform.

With the signal line attached to the second platform and running taut, and with the main load line fastened to the load to be picked off of the second platform and also running taut, the crane operator turns operation over to the sensor means and to automatic control means. These means determine a point at which the second platform is moving upward toward the first platform and at which the rate of change of the movement of the second platform toward the first is zero. At this point, the sensor and control means causes the variable displacement main hoist drum motor and both the variable displacement platform locator pump and the variable displacement main hoist drum control pump to go to maximum displacement thus providing the main hoist drum with maximum possible power to cause the load to be picked off of the second platform at the point of maximum upward velocity of the second platform with respect to the first.

Once the load is clear of the second platform, the platform locator pump can be returned to zero stroke and the load can be lifted toward the boom, the crane can be pivoted on its vertical axis, and the load deposited on the first platform under the control of the main load line control means.

DETAILED DESCRIPTION OF THE PREFERRED EMBODIMENT

Figure 1:
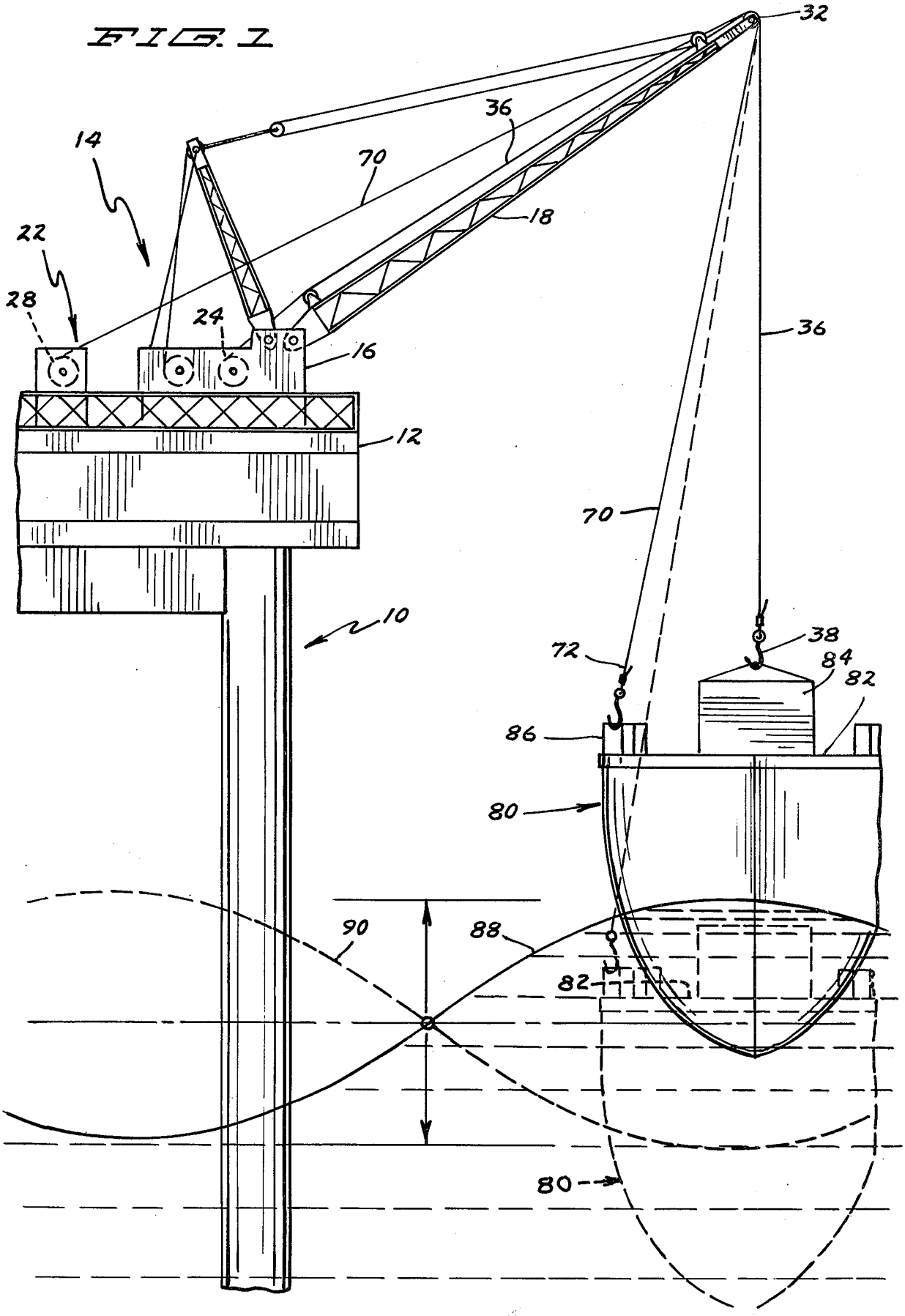
FIG. 1 shows an offshore oil rig providing a first platform with a crane mounted on it and a supply vessel providing a second platform and having a load on it to be transported to the first platform, the supply vessel being shown in full lines supported at its peak position on an ocean heave, swell or wave and in dotted lines at its trough position supported in the wave trough.

An offshore oil rig 10 provides a first platform 12 which is relatively unaffected by ocean wave movement. Mounted on the first platform 12 is a crane assembly 14 which includes a crane upper works 16, a crane boom 18 pivotably mounted to the upper works, a main hoist winch 20, and a signal line winch 22. Main hoist winch 20 includes a main hoist drum 24 and main hoist brake 26; while signal line winch 22 includes signal line drum 28 and signal line brake 30. Each winch is so constructed that when it is powered for rotating its drum in either direction, its brake is released; otherwise its brake is set.

The boom 18 includes a boom point 32 and appropriate boom point sheaves. A main load line 36 is operably attached to main hoist drum 24 and has an outer end portion extending over one of the boom line sheaves to terminate in an outer end to which is attached a means for fastening the load line to a load. This means is herein shown as a main load hook 38.

Figure 2:
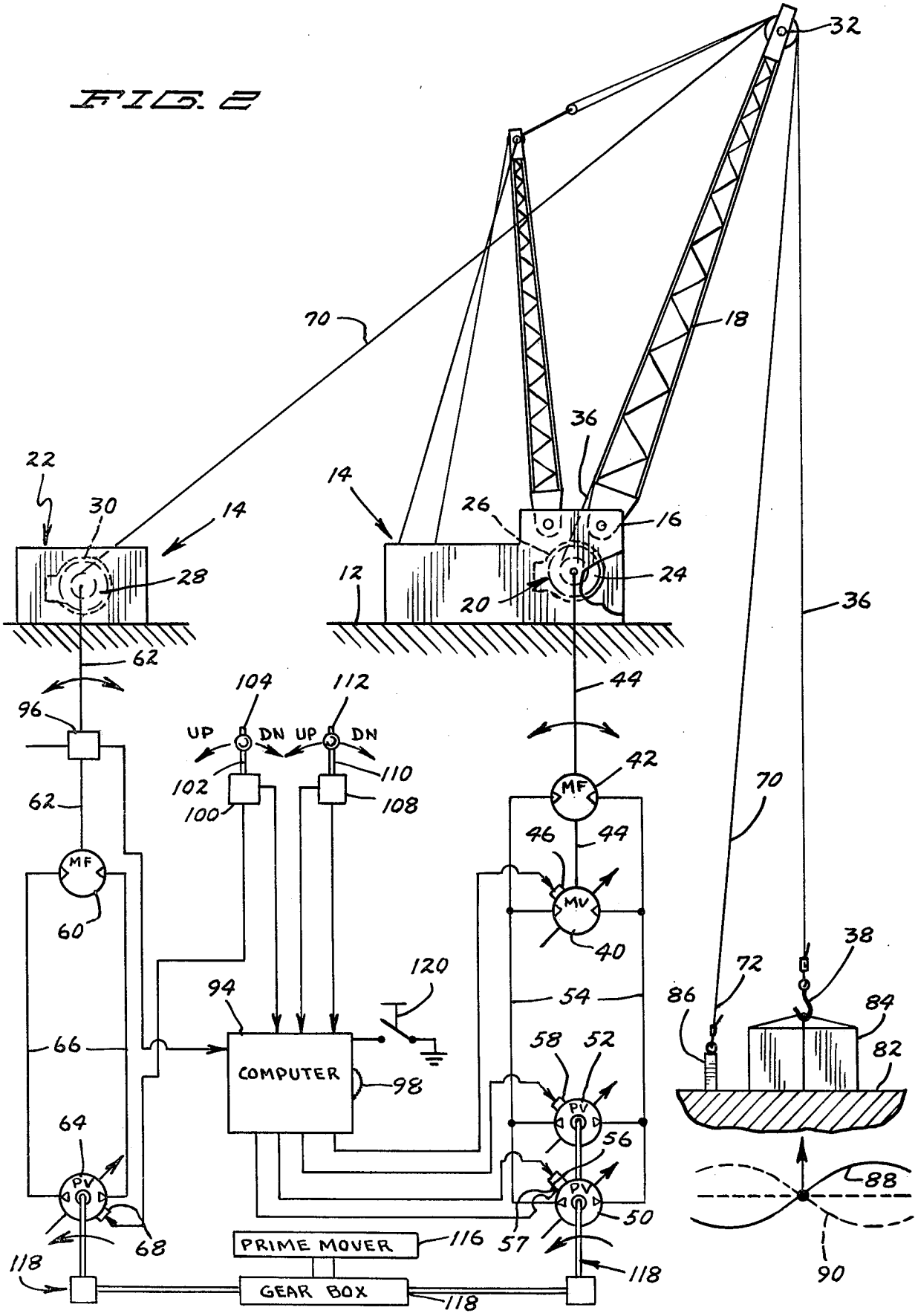
FIG. 2 is a schematic representation of the elements in FIG. 1 showing the heave motion compensation apparatus of the invention.

Main hoist drum 24 is connected through appropriate gearing to a variable displacement, swash-plate controlled first main hoist drum motor 40 and to a second main hoist drum motor 42 shown here as a fixed displacement motor. This connection between the motors and the main hoist drum is shown schematically at 44 in FIG. 2. Variable displacement first main hoist drum motor 40 is equipped with an electronic displacement control 46.

A variable displacement, swash-plate controlled platform locator pump 50 and a variable displacement, swash-plate controlled main hoist control drum pump 52 are connected through an appropriate hydrostatic transmission to the first and second main hoist motors 40 and 42. This connection is shown schematically at 54. Platform locator pump 50 is equipped with an electronic two-pressure value pressure override control 56 and with an electronic displacement control 57. The main hoist drum control pump 52 is equipped with an electronic displacement control 58.

A fixed displacement hydraulic signal line motor 60 is attached through appropriate planetary gearing to be in driving relationship to the signal line drum 28. This connection is shown schematically at 62 in FIG. 2. A variable displacement, swash-plate controlled signal line pump 64 is drivingly connected to signal line motor 60 through an appropriate hydrostatic transmission 66. Signal line pump 64 is equipped with a torque sensitive control 68.

While a hydrostatic tensioning device has been disclosed herein, it is to be understood that other tensioning devices such as electric or pneumatic tensioning devices could also be used effectively.

A signal line 70 is operatively connected to the signal line drum 28 and an outer end portion of the signal line extends over one of the sheaves at the boom point 32 to terminate in an outer end 72.

A supply vessel or tender 80 provides a second platform 82 on which is situated a load 84 which is appropriately rigged to be fastened to the main load hook 38 at an appropriate time. Signal line fastening means 86, here shown to be in the nature of a supply vessel railing, is provided for fastening the outer end 72 of the signal line 70 in adjacent relationship to the load 84 on the second platform 82.

An ocean swell or wave 88 is indicated in full lines in FIG. 1 to be supporting the supply vessel 80 and consequently the second platform 82 at its peak or maximum height position. The ocean swell or wave 90 indicated in dotted lines in FIG. 1 is illustrated as supporting the supply vessel and second platform in its trough or minimum height position. These same waves are illustrated schematically in FIG. 2, but show the second platform schematically positioned at its critical takeoff point where the platform has its maximum upward speed at it is lifted by the progress of the swell or wave 88.

The waves 88 can be considered to be moving from left to right in the plane of the paper, for example. In an actual offloading situation, the supply vessel 80 would typically be headed into the wind, and consequently, at least somewhat into the prevailing swell or waves. The supply vessel 80 is shown herein, however, as being broadside to the waves as an aid to the understanding of the relationship of the wave action to the chosen pickoff point.

The control of the heave motion compensation apparatus of the invention is accomplished through the use of a computer 94 which will normally be positioned on the offshore oil rig 10. A first sensor means 96 constituted as an electronic speed and direction sensor is mechanically connected with the gearing 62 between the signal line motor 60 and the signal line drum 28. This sensor develops a signal representative of the speed and direction of rotation of the signal line drum 28 which it feeds to the computer 94. Because of changes in the effective diameter of the signal line drum 28 and the main hoist drum 24, due to the changing parts of the hoist line or the changing layers on the drums, a thumb wheel controlled reostat 98 is incorporated to modify the signals received from sensor 96 as needed to take care of these errors.

Signal line drum control means includes the torque sensitive swash-plate control 68 of signal line pump 64, a level controlled signal line controller 100 which provides input to the swash-plate control 68. A manual control lever 102 of the signal line controller 100 is provided with a pressure override thumb button 104 to control the pressure override control 56 of the platform locator pump 50 to limit the pressure output of the platform locator pump 50 to its minimum value. This button is used for maintaining the minimum amount of tension in the load line 36 after it is connected to the load 84.

The main load line control means includes a lever controlled main hoist controller 108 having a control lever 110. This controller 108 consists of a linear potentiometer which feeds a linear signal into and through the computer 94 to the electronic displacement control 58 of the main hoist drum control pump 52. This controls the speed and direction of the main hoist drum 24 by means of controlling the positioning of the swach-plate and consequently the stroking of the main hoist control pump 52.

Control lever 110 is provided with a "pick-off" control thumb button 112. This button, when depressed, feeds a signal to the computer which instructs the computer to override all other systems and to supply full power to hoisting the load once the supply vessel 80 and the second platform 82 are next moving in upward direction at their maximum velocity.

As disclosed herein, the three variable displacement pumps 50, 52 and 64 are driven by a prime mover or power means 116 acting through appropriate gearing and pump drive shafts indicated generally at 118.

OPERATION

With the supply ship moored with respect to the offshore oil rig in position so that the load to be picked off from the second platform 82 is directly beneath the boom point 32, and with the prime mover operating at maximum governor speed, all three variable displacement pumps 50, 52 and 64 are stroked to neutral position. In other words, control levers 102 and 110 are in neutral position with thumb buttons 104 and 112 in the "UP" position. Main hoist brake 26 and signal line brake 30 are in the "SET" position. A computer control switch 120 will be closed to activate the computer and the rest of the motion compensation control circuitry.

To lower the signal line 70 to the supply boat deck or second platform 82, control lever 102 of the signal line controller 100 will be moved to the down position. This releases the brakes on signal line drum 28 and drives the drum to lower the outer end 72 of the signal line 70 toward the second platform.

Simultaneously, the operator will depress pressure override thumb button 104 to reduce the pressure override setting on the platform locator pump 50 to its minimum setting. Since the brakes are set on the main hoist drum 26, main load line 36 and load hook 38 will remain stationary with respect to the boom point 32.

When the signal line reaches the second platform, it will be fastened to the supply boat as at 86 in adjacent relationship to the load 84.

The control lever 102 of the signal line controller 100 will now be moved to the "UP" position. This will cause the slack to be taken out of the signal line 70 and will cause the signal line to follow the motion of the second platform 82 under a constant line tension.

The main load line 36 and its main load hook 38 will be moved to the load 84. To do this, the main hoist brake 26 will be released. This will allow the signal being received by the computer 94 from the first sensor means 96 and the resulting signal from the computer being fed to the electronic two-pressure value pressure override control 56 of the platform locator pump 50 to cause the swash-plate angle of pump 50 to vary on either side of the neutral position. Doing so causes the main load hook 38 to follow the motion of the second platform 82. If the main hook does not remain precisely stationary with respect to the supply boat, the thumb wheel controlled reostat 98 will be adjusted to obtain a finer control.

The operator will now move the main hoist control lever 110 of the main hoist controller 108 to the "DOWN" position. This causes main hoist drum control pump 52 to go into stroke at a position proportional to the travel of control lever 110. This causes the main hook to move downward toward the second platform at a constant rate with respect to that platform but erratically with respect to the operator of the crane located in fixed vertical relation with respect to the first platform 12.

When the hook 38 arrives at the load 84, and after adjustments have been made so that there is no relative vertical movement between the two, load slings encompassing the load 84 will be attached to the main hook 38. The control lever 110 of the main hoist controller 108 will then be moved to the "UP" position. This causes the main load line 36 and the hook 38 to move upwards until all of the slack is taken out of the load slings. The tension in the slings and in the load line 36 is now dictated by the pressure override setting as controlled by the depressed thumb button 104. The main line 36 and the hook 38 are now under the control of platform locator pump 50 and will follow the motion of the second platform 82 under a constant line tension.

Control lever 110 of the main hoist controller will now be moved to a neutral position.

To pick-off the load, the crewmen on the second platform will check to see that all hook points have been made properly, to see that the load 84 is not attached to the supply vessel 80, and to see that the signal line 70 is not tangled with the main load line 36, the slings or the load. The crewman on the supply vessel then signals the crane operator on the first platform that the load is ready to pick.

The crane operator then depresses "pick-off" control thumb button 112 on control lever 110. This turns control over to the computer 94. It, acting on input from the other controls, determines the optimum time to pick up the load. This point is determined by the computer when the signal from the first sensor means indicates that the second platform is moving upward toward the first platform. A second sensor means within the computer uses this information and the information from the first sensor means as to the speed of movement of the platforms toward each other to plot the rate of change of speed of movement. When this rate of change of movement passes from acceleration of movement to deceleration of movement, it goes through a point where there is zero rate of change. At this point, the electronic signal from thumb button 104 is overridden and the output from platform locator pump 50 goes to its maximum; main hoist drum control pump 52 goes to maximum displacement; and first main hoist drum motor 40 also goes to maximum displacement. This causes full power to be supplied to main hoist drum 24, thus snatching the load 84 from second platform 82 at the point where the load has its maximum upward velocity and the speed of upward movement of the second platform is just beginning to diminish. At this point, all of the momentum of the various elements is in a direction to complement the effort of moving the load away from the second platform. This includes the main hoist drum 24, the gearing between the drum 24 and the main hoist motors, as well as the first and second main hoist motors themselves, and the load 84 with platform 82.

After the lift-off has been accomplished, and when the load is clear of the supply vessel, computer control switch 120 will be opened to deactivate the motion compensating system. This will turn control of the load over to a main hoist controller 108 and its control lever 110. These controls will control the main hoist drum control pump 52 to hoist the load to the level of the first platform. Signal line 70 can be unfastened from the second platform 82. When this has been accomplished, the crane upper works 16 can be swung so that the load 82 can be lowered onto the first platform 12.

The use of a variable displacement main hoist motor to cause the main hook to follow the motion of the second platform, and the use of a motor acting as a fixed displacement motor to move the main hook toward and away from the boom point of the first platform, together with the use of variable displacement pumps to drive these motors to accomplish these purposes is shown herein in connection with lifting the load at the point of maximum upward velocity of the load and of the second platform toward the first. However, this combination of elements will also be effective to pick-off the load or to land the load with respect to a second platform at some other point in the periodic up and down cycle of the second platform if that, for any reason, should become desirable.

By the same token, means other than the attachment of a signal line between the first and second platforms can be used to generate signals representative of the speed and direction of motion of the two platforms with respect to each other.

Furthermore, means other than the particular combination of main hoist motors and pumps can be used to pick-off the load from a second platform at the optimum point of maximum upward platform velocity of the second toward the first.

Although the present invention has been described with reference to preferred embodiments, workers skilled in the art will recognize that changes may be made in form and detail without departing from the spirit and scope of the invention.

What is claimed is:

1. Heave motion compensation apparatus for use with a crane for transporting a load between twio platforms moving vertically with respect to each other with a cyclical movement, said apparatus including:

A. a crane boom mounted on a first of said platforms and having a boom point above and in vertical clearing relation to a load on a second of said platforms, B. a main hoist drum mounted on said first platform;

C. a main load line operably mounted on said main hoist drum and having an outer end portion extending over the boom point and terminating in an outer end;

D. load line fastening means for attaching said outer end of said main load line to said load when said load is situated on said second platform;

E. power means;

F. first sensor means operable to develop a first signal representative of the speed and direction of movement of the two platforms toward and away from each other;

G. second sensor means operable to develop a second signal representative of the rate of change of the speed of movement of the platforms toward each other;

H. lifting means including the power means operative to rotate the main hoist drum to cause the load line to lift the load from the second platform; and I. pick-off control means operable to activate said lifting means responsive to the simultaneous presence of a first signal representative of movement of the platforms toward each other and of a second signal representative of a zero rate of change of speed of such movement of the platforms toward each other.

2. A crane for transporting a load between two platforms moving vertically with respect to each other with a cyclical movement, said crane including:

A. a crane boom mounted on a first of said platforms and having a boom point above and in vertical clearing relation to a load on a second of said platforms;

B. a main hoist drum mounted on said first platform;

C. a main load line operably mounted on said main hoist drum and having an outer end portion extending over the boom point and terminating in an outer end;

D. load line fastening means for attaching said outer end of said main load line to said load when said load is situated on said second platform;

E. a signal line drum mounted on said first platform;

F. a signal line operably mounted on said signal line drum and having an outer end portion extending over said boom point and terminating in an outer end;

G. signal line fastening means for attaching the outer end of the signal line to the second platform;

H. a signal line motor in operative relation to said signal line drum;

I. signal line motor drive means line pump in driving relation to said signal line motor;

J. computer means;

K. signal line drum control means operative on said signal line motor and said signal line motor drive means to cause said signal line drum to keep the signal line taut when it is attached to the second platform;

L. first sensor means operable to develop and feed to said computer means a first signal respresentative of the speed and direction of movement of the outer end of said signal line;

M. second sensor means including said computer means operable to develop from said first signal a second signal representative of the rate of change of said speed of movement of said signal line;

N. a hydraulic variable displacement first main hoist drum motor drivingly associated with said main hoist drum;

O. a hydraulic second main hoist drum motor drivingly associated with the main hoist drum;

P. a hydraulic variable displacement platform locator pump in driving relation to said main hoist motors;

Q. compensation control means including said computer means operable to vary the displacement of said locator pump responsive to said first signal to drive at least one of said main hoist drum motors to rotate said main hoist to cause the free end of the main load line to move up and down with respect to said first platform in such a manner as to have substantially no vertical movement with respect to said second platform;

R. a hydraulic variable displacement main hoist drum control pump in driving relation to said main hoist motors;

S. main load line control means selectively operable in first and second directions to vary the displacement of said main hoist drum control pump to drive said main hoist drum motors to rotate said main hoist to cause said outer end of said load line to move selectively in a downward and in an upward direction; and T. pick-off control means including said computer means operative to fully activate said locator pump, said main hoist drum control pump and said variable displacement main hoist drum motor all to maximum displacement to pick said load off said second platform at a critical point responsive to the simultaneous presence of a first signal representing movement of said platforms toward each other and a second signal representative of a zero rate of change of speed of such movement of the platforms toward each other.

3. The crane of claim 2 wherein:

U. the first sensor means includes an electronic speed and direction sensor mechanically coupled to sense the rotation of the signal line drum and operative to develop and send to the computer means a signal representative of the speed and direction of signal drum rotation.

4. The crane of claim 3 wherein:

V. the first sensor means also includes a manually controllable device for modifying the signal received from said electronic sensor to cause the movement of the outer end of the main hoist line to more exactly conform to the vertical movement of the second platform.

5. The crane of claim 3 wherein:

U. the platform locator pump is of the swash plate type and is provided with an electronic displacement control operative to vary the displacement of said locator pump; and V. the compensation control means includes means to feed a signal from the computer means to said locator pump displacement control.

6. The crane of claim 5 wherein:

W. the platform locator pump is also provided with an electronic two-pressure value pressure override control;

X. the first main hoist drum motor and the main hoist drum control pump are each of the swash plate type and are each provided with an electronic displacement control; and Y. the pick-off control means includes:

(1) a manually operable control button operative to cause the locator pump pressure override control to limit the locator pump to a minimum pressure output, (2) a manually operable pick-off control button operative to cause the computer means to select said critical point in the cyclical vertical movement between the first and second platforms, and, at that critical point to:

(a) override the locator pump override control to condition the locator pump to deliver a maximum pressure output, and (b) to cause the electronic displacement controls of said first main hoist drum motor, said main hoist drump pump and said platform locator pump to condition said motor and pump for maximum displacement.

7. The crane of claim 2 wherein:

U. said signal line motor is a hydraulic motor;

V. said signal line motor drive means is a hydraulic variable displacement signal line pump of the swash plate type; and W. the signal line drum control means includes a torque sensitive swash plate control operative on said signal line pump.

8. The crane of claim 7 wherein:

X. the signal line drum control means also includes a lever operated signal line controller operative to transmit signals to said swash plate control to cause said signal line end to tend to move selectively in upward and downward direction.

9. Heave motion compensation apparatus for use with a crane for transporting a load between two platforms moving vertically with respect to each other with a cyclical movement, said crane including:

a. a crane boom mounted on a first of said platforms and having a boom point above and in vertical clearing relation to a load on a second of said platforms, b. a main hoist drum mounted on said first platform, c. a main load line operably mounted on said main hoist drum and having an outer end portion extending over the boom point and terminating in an outer end, d. load line fastening means for attaching said outer end of said main load line to said load when said load is situated on said second platform, e. a signal line drum operably mounted on said first platform, f. a signal line operably mounted on said signal line drum and having an outer end portion extending over said boom point and terminating in an outer end, and g. signal line fastening means for attaching the outer end of the signal line to the second platform, said heave motion compensation apparatus including:

A. first power means including at least one prime mover;

B. second means including the first power means operative on said signal line drum to keep said signal line taut when the signal line is attached to the second platform;

C. third means to monitor the longitudinal movement of the signal line and to develop a first signal representative of the speed and direction of longitudinal movement of the signal line and to develop a second signal representative of the rate of change of said speed of movement;

D. fourth means including said first power means operative on the main hoist drum to cause the load line to lift the load from the second platform; and E. fifth pick-off control means operable to activate said fourth means responsive to the simultaneous presence of a first signal representative of movement of the platforms toward each and of a second signal representative of a zero rate of change of speed of such movement of the platforms toward each other.

10. Heave motion compensation apparatus for use with a crane for transporting a load between two platforms moving vertically with respect to each other with a cyclical movement, said crane including:

a. a crane boom mounted on a first of said platforms and having a boom point above and in vertical clearing relation to a load on a second of said platforms, b. a main hoist drum mounted on said first platform, c. a main load line operably mounted on said main hoist drum and having an outer end portion extending over the boom point and terminating in an outer end, d. load line fastening means for attaching said outer end of said main load line to said load when said load is situated on said second platform, e. a signal line drum operably mounted on said first platform, f. a signal line operably mounted on said signal line drum and having an outer end portion extending over said boom point and terminating in an outer end, and g. signal line fastening means for attaching the outer end of the signal line to the second platform;

said heave motion compensation apparatus including:

A. a hydraulic signal line motor in operative relation to said signal line drum;

B. a hydraulic variable displacement signal line pump in driving relation to said signal line motor;

C. computer means;

D. signal line drum control means operative on said signal line motor and pump to cause said signal line drum to keep said signal line taut when the signal line is attached to the second platform;

E. first sensor means operable to develop and feed to said computer means a first signal representative of the speed and direction of movement of the outer end of said signal line;

F. second sensor means including said computer means operable to develop from said first signal a second signal representative of the rate of change of said speed of movement of said signal line;

G. a hydraulic variable displacement first main hoist drum motor drivingly associated with said main hoist drum;

H. a hydraulic second main hoist drum motor drivingly associated with said main hoist drum;

I. a hydraulic variable displacement platform locator pump in driving relation to said main hoist drum motors;

J. compensation control means including said computer means operable to vary the displacement of said locator pump responsive to said first signal to drive at least one of said main hoist drum motors to rotate said main hoist drum to cause the free end of said main hoist line to move up and down with respect to said first platform in such a manner as to have substantially no vertical movement with respect to said second platform;

K. a hydraulic variable displacement main hoist drum control pump in driving relation to said main hoist drum motors;

L. main load line control means selectively operable in first and second directions to vary the displacement of said main hoist drum control pump to drive at least one of said main hoist drum motors to rotate said main hoist to cause said outer end of said load line to move selectively in a downward and in an upward direction; and M. pick-off control means including said computer means for fully activating said locator pump, said main hoist drum control pump and the variable displacement main hoist drum motor all to maximum displacement to pick said load off of said second platform responsive to the simultaneous presence of a first signal representing movement of said platforms toward each other and of a second signal representative of a zero rate of change of speed such movement of the platforms toward each other.

11. Heave motion compensation apparatus for use with a crane for transporting a load between two platforms moving vertically with respect to each other with a cyclical movement, said crane including:

a. a crane boom mounted on a first of said platforms and having a boom point above and in vertical clearing relation to a load on a second of said platforms, b. a main hoist drum mounted on said first platform, c. a main load line operably mounted on said main hoist drum and having an outer end portion extending over the boom point and terminating in an outer end, d. load line fastening means for attaching said outer end of said main load line to said load when said load is situated on said second platform, e. a signal line drum operably mounted on said first platform, f. a signal line operably mounted on said signal line drum and having an outer end portion extending over said boom point and terminating in an outer end, and g. signal line fastening means for attaching the outer end of the signal line to the second platform;

said heave motion compensation apparatus including:

A. a hydraulic signal line motor in operative relation to said signal line drum;

B. a hydraulic variable displacement signal line pump in driving relation to said signal line motor;

C. computer means;

D. signal line drum control means operative on said signal line motor and pump to cause said signal line drum to keep said signal line taut when the signal line is attached to the second platform;

E. sensor means operable to develop and feed to said computer means a signal representative of the speed and direction of movement of the outer end of said signal line;

F. a hydraulic variable displacement first main hoist drum motor drivingly associated with said main hoist drum;

G. a hydraulic second main hoist drum motor drivingly associated with said main hoist drum;

H. a hydraulic variable displacement platform locator pump in driving relation to said main hoist drum motors;

I. compensation control means including said computer means operable to vary the displacement of said locator pump responsive to said first signal to drive at least one of said main hoist drum motors to rotate said main hoist drum to cause the free end of said main hoist line to move up and down with respect to said first platform in such a manner as to have substantially no vertical movement with respect to said second platform;

J. a hydraulic variable displacement main hoist drum control pump in driving relation to said main hoist drum motors;

K. main load line control means selectively operable in first and second directions to vary the displacement of said main hoist drum control pump to drive at least one of said main hoist drum motors to rotate said main hoist to cause said outer end of said load line to move selectively in a downward and in an upward direction; and L. pick-off control means including said computer means for fully activating said locator pump, said main hoist drum control pump and the variable displacement main hoist drum motor all to maximum displacement to pick said load off of said second platform responsive to the occurrence of a predetermined relationship between the movement and position of the platforms with respect to each other as indicated by said signal.

12. A crane for transporting a load between two platforms moving vertically with respect to each other with a cyclical movement, said crane including:

A. a crane boom mounted on a first of said platforms and having a boom point above and in vertical clearing relation to a load on a second of said platforms;

B. a main hoist winch mounted on said first platform;

C. a main load line operably mounted on said main hoist winch and having an outer end portion extending over the boom point and terminating in an outer end;

D. load line fastening means for attaching said outer end of said main load line to said load when said load is situated on said second platform;

E. a signal line winch mounted on said first platform;

F. a signal line operably mounted on said signal line winch and having an outer end portion extending over said boom point and terminating in an outer end;

G. signal line fastening means for attaching the outer end of the signal line to the second platform;

H. a hydraulic signal line motor in operative relation to said signal line winch;

I. a hydraulic variable displacement signal line pump in driving relation to said signal line motor;

J. computer means;

K. signal line winch control means operative on said signal line motor and pump to cause said signal line winch to keep the signal line taut when it is attached to the second platform;

L. first sensor means operable to develop and feed to said computer means a first signal representative of the speed and direction of movement of the outer end of said signal line;

M. second sensor means including said computer means operable to develop from said first signal a second signal representative of the rate of change of said speed of movement of said signal line;

N. a hydraulic variable displacement first main hoist winch motor drivingly associated with said main hoist winch;

O. a hydraulic second main hoist winch motor drivingly associated with the main hoist winch;

P. a hydraulic variable displacement platform locator pump in driving relation to said main hoist motors;

Q. compensation control means including said computer means operable to vary the displacement of said locator pump responsive to said first signal to drive at least one of said main hoist winch motors to rotate said main hoist to cause the free end of the main load line to move up and down with respect to said first platform in such a manner as to have substantially no vertical movement with respect to said second platform;

R. a hydraulic variable displacement main hoist winch control pump in driving relation to said main hoist motors;

S. a main load line control means selectively operable in first and second directions to vary the displacement of said main hoist winch control pump to drive said main hoist winch motors to rotate said main hoist to cause said outer end of said load line to move selectively in a downward and in an upward direction; and T. pick-off control means including said computer means operative to fully activate said locator pump, said main hoist winch control pump and said variable displacement main hoist winch motor all to maximum displacement to pick said load off said second platform at a critical point responsive to the simultaneous presence of a first signal representing movement of said platforms toward each other and a second signal representative of a zero rate of change of speed of such movement of the platforms toward each other.

13. The crane of claim 12 wherein:

U. each winch includes a drum and a brake; and

V. each brake is "set" except where its winch is powered for rotating its drum.

14. Heave motion compensation apparatus for use with a crane for transporting a load between two platforms moving vertically with respect to each other with a cyclical movement, said crane including:

a. a crane boom mounted on a first of said platforms and having a boom point above and in vertical clearing relation to a load on a second of said platforms, b. a main hoist winch mounted on said first platform, c. a main load line operably mounted on said main hoist winch and having an outer end portion extending over the boom point and terminating in an outer end, d. load line fastening means for attaching said outer end of said main load line to said load when said load is situated on said second platform, e. a signal line winch operably mounted on said first platform, f. a signal line operably mounted on said signal line winch and having an outer end portion extending over said boom point and terminating in an outer end, and g. signal line fastening means for attaching the outer end of the signal line to the second platform, said heave motion compensation apparatus including:

A. first power means including at least one prime mover;

B. second means including the first power means operative on said signal line winch to keep said signal line taut when the signal line is attached to the second platform;

C. third means to monitor the longitudinal movement of the signal line and to develop a first signal representative of the speed and direction of longitudinal movement of the signal line and to develop a second signal representative of the rate of change of said speed of movement;

D. fourth means including said power means operative on the main hoist winch to cause the load line to lift the load from the second platform; and E. fifth pick-off control means operable to activate said fourth means responsive to the simultaneous presence of a first signal representative of movement of the platforms toward each and of a second signal representative of a zero rate of change of speed of such movement of the platforms toward each other.

15. The crane of 14 wherein:

F. each winch includes a drum and a brake; and

G. each brake is "set" except where its winch is powered for rotating its drum.

* * * * *

UNITED STATES PATENT AND TRADEMARK OFFICE

CERTIFICATE OF CORRECTION

PATENT NO. : 4,448,396

DATED : May 15, 1984

INVENTOR(S) : PIERRE C. DELAGO

It is certified that error appears in the above-identified patent and that said Letters Patent is hereby corrected as shown below:

Column 9, lines 16 and 17, "point of maximum upward platform velocity of the second toward the first." should be --point of maximum upward velocity of the second platform toward the first.--.

Column 9, line 25, "twio" should be --two--.

Signed and Sealed this

*Eleventh* Day of *September 1984*

[SEAL]

*Attest:*

GERALD J. MOSSINGHOFF

*Attesting Officer*

*Commissioner of Patents and Trademarks*